United States Patent [19]

Sumitani

[11] Patent Number: 5,017,130

[45] Date of Patent: May 21, 1991

[54] BURNER FOR A COMBUSTION DEVICE

[75] Inventor: Shigeto Sumitani, Fuji, Japan

[73] Assignee: Kabushiki Kaisha Toshiba, Kawasaki, Japan

[21] Appl. No.: 558,481

[22] Filed: Jul. 27, 1990

[30] Foreign Application Priority Data

Sep. 14, 1989 [JP] Japan ..... 1-237198

[51] Int. Cl.[5] ..... F23D 14/00

[52] U.S. Cl. ..... 431/352; 431/353

[58] Field of Search ..... 431/352, 353

[56] References Cited

U.S. PATENT DOCUMENTS

| | | | |
|---|---|---|---|
| 3,368,604 | 2/1968 | Mutchler | 431/352 |
| 4,802,529 | 2/1989 | Sumitani et al. . | |
| 4,927,356 | 5/1990 | Otsuka et al. | 431/352 |

FOREIGN PATENT DOCUMENTS

| | | |
|---|---|---|
| 63-109829 | 7/1988 | Japan . |
| 1142371 | 6/1989 | Japan . |
| 1039496 | 8/1966 | United Kingdom . |
| 1189364 | 4/1970 | United Kingdom . |
| 1255602 | 12/1971 | United Kingdom . |
| 1381981 | 1/1975 | United Kingdom . |
| 1442758 | 7/1976 | United Kingdom . |
| 0089924 | 9/1983 | United Kingdom . |

*Primary Examiner*—Carroll B. Dority

*Attorney, Agent, or Firm*—Cushman, Darby & Cushman

[57] ABSTRACT

A mixer has its associated fuel gas nozzle inserted on one side and includes an inlet section for introducing combustion air via a gap defined therearound to allow it with a fuel and a jetting outlet section for jetting a resultant air/fuel mixture. A cylinder is fixed to the jetting outlet section to burn the mixture. A burner head is fixed to the cylinder to allow the mixture which is jetted from the jetting outlet section via diffusion holes to be guided into the cylinder.

10 Claims, 3 Drawing Sheets

BURNER FOR A COMBUSTION DEVICE

BACKGROUND OF THE INVENTION

1. Field of the Invention

The present invention relates to a burner for a combustion device which heats, for example, a refrigerant.

2. Description of the Related Art

A refrigerant heating device for heating, for example, a refrigerant is disclosed in Published Unexamined Japanese Patent Application 1-142371.

The refrigerant heating device includes a combustion device.

The combustion device comprises a mixer, bottom plate and burner.

The mixer has a fuel gas nozzle and primary air inlet on one end and an inner cylinder is provided in the mixer, allowing a fuel gas and primary air to be mixed in the mixer.

A jetting hole is provided in the bottom plate to jet a gas/air mixture into the burner from the inner cylinder.

A spark plug is provided in the burner to fire a mixture jetted from the jetting hole.

A flame outlet is provided on the outer periphery of the burner to guide secondary air. The secondary air is mixed with the mixture to provide an ideal combustion gas concentration so that it is fired.

A refrigerant tube is heated by heat of a hot combustion gas.

A burner for a combustion device in a water heater is disclosed, for example, in Published Unexamined Japanese Utility Model Application 63-109829.

The burner has a flame outlet for jetting a mixture of a gas fuel and primary air. The wall extends at a specific attitude from one side of the frame outlet so as to provide a firing zone.

A jetting outlet is provided in the wall to jet secondary combustion air.

A tube-like guide passage is defined for jetting a mixture with a cylindrical opening provided, as a flame outlet, at one end. The guide passage has its axis oriented at such an attitude as to conform to the direction in which the wall extends.

In either combustion device, the respective component parts are formed by bending or drawing a very thin metal plate.

The respective component parts are assembled as a cylinder or box whose width is very great compared to its height.

By so doing, it is possible to assemble a combustion device.

It is necessary to build up a rigid structure which is not readily broken due to some external shock.

For this reason, the conventional method was by assembling together respective associated component parts by an arc welding means.

The respective associated component parts are liable to be affected by heat involved and, even if being slightly heat-deformed, vary at their mounting position.

This causes a clearance or clearances to be produced between the component parts, resulting in a leakage of a fuel gas or primary air and in an unstable combustion.

SUMMARY OF THE INVENTION

It is accordingly the object of the present invention to provide a burner for a combustion device which, through the assembling together of respective component parts by a simple means, such as fixing means, can achieve an accurate positioning and can obtain a steady, normal firing state, at all times, by controlling the generation of heat deformation as well as the leakage of primary air.

According to the present invention, there is provided a burner for a combustion device, comprising:

a fuel gas nozzle for supplying a fuel gas;

a mixture (an air/fuel mixing chamber) into which the fuel gas nozzle inserted on one side and including an inlet section for introducing combustion air via a gap defined therearound to mix a fuel gas with the combustion air in the mixer;

a jetting outlet section integrally projected on the other side of the mixer and having jetting holes for jetting the fuel gas and combustion air as a mixture in a rectified, homogenized stream;

a cylinder fixed to the jetting outlet section by a means, such as spot welding or crimping, having a substantially rectangular open end and secondary flame holes in the circumferential wall, and adapted to allow the mixture to be burned; and a burner head fixed to the cylinder and including diffusion holes for causing the mixture which is jetted from the jetting holes to be diffused at a predetermined angle to the wall surface of the cylinder.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

One embodiment of the present invention will be explained below with reference to the accompanying drawings.

Figure 1:
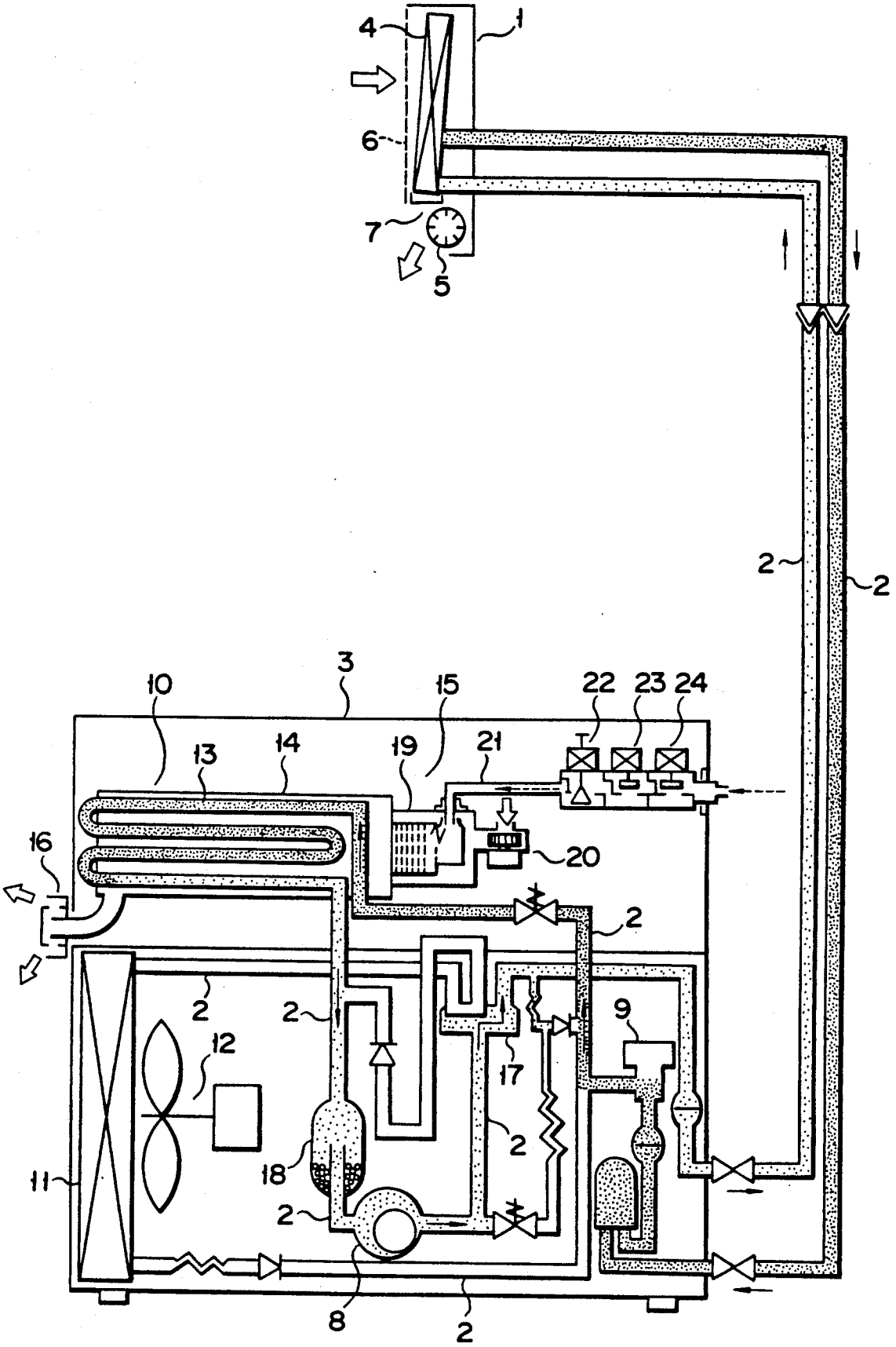
FIG. 1 is a view generally showing an air conditioner according to an embodiment of the present invention.

In FIG. 1, an indoor unit 1 is connected via refrigerant tubes 2,2 to an outdoor unit 3, these units comprises a refrigerant heating type air conditioner.

The indoor unit 1 includes a heat exchanger 4 and indoor fan 5 on the indoor unit side.

The heat exchanger 4 on the indoor unit side allows an exchange to be made between incoming refrigerant's heat and indoor air heat.

A suction air inlet 6 is provided at the front side of the indoor unit 1 and an exhaust air outlet 7 at the lower side.

The outdoor unit 3 includes a compressor 8, electronic expansion valve 9, refrigerant heater 10 and heat exchanger 11 on the outdoor side.

The compressor 8 and electronic expansion valve 9 are connected by a refrigerant tube 2 to the indoor exchanger 4 via the refrigerant heater 10 in a heating operation mode or the outdoor heat exchanger 11 in a cooling operation mode.

The compressor 8 sucks a refrigerant from the suction-side refrigerant tube 2, compresses it and delivers it via a deliver side refrigerant tube 2.

The electronic expansion valve 9 serves to optimally decompress a refrigerant pressure in a refrigerant mode and optimally controls a refrigerant flow in a heating operation mode.

The outdoor heat exchanger 11 is employed at a time of a cooling operation only and allows an exchange to be made between heat evolved in a refrigerant compression mode and outdoor air heat, that is, radiates heat toward the outdoor side.

A fan 12 is provided opposite to the outdoor heat exchanger 11 and adapted to send outer air into the outdoor heat exchanger 11.

The refrigerant heater 10 comprises a heater casing 14 with a heating refrigerant tube 13 therein, a combustion device 15 connected to one end of the heater casing 14, and an exhaust top 16 connected to the other end of the heater casing.

The combustion device 15 kindles a flame and heats the refrigerant tube 13, as well as a refrigerant flowing through the refrigerant tube, with a burning gas flame.

The exhaust top 16 externally delivers an exhaust gas in the heater casing 14.

The heating refrigerant tube 13 in the refrigerant heater 10 and outdoor heat exchanger 11 are connected to the compressor 8, in a parallel array, through a four-way valve 17.

The four-way valve 17 connects the refrigerant tube 2 on the delivery side of the compressor 8 to the indoor heat exchanger 4 and connects the refrigerant tube 2 on the suction side of the compressor 8 to the outdoor heat exchanger 11 via a check valve when a heating operation is performed. The four-way valve 17 connects refrigerant tube 2 on the deliver side of the compressor 8 to the outdoor heat exchanger 11 and connects the refrigerant tube 2 on the suction side of the compressor 8 to the refrigerant tube 2 leading to the indoor heat exchanger when a cooling operation is performed. An accumulator 18 is provided on the refrigerant tube 2 on the suction side of the compressor 8.

The combustion device 15 includes a burner 19, burning fan 20 and fuel gas supply tube 21.

The burner 19 mixes combustion air with a fuel gas and burns a resultant mixture at which time the burning fan 20 feeds combustion air to the burner 19. A fuel gas supply tube 21 feeds a fuel gas to the burner 19.

A gas burning capacity control valve 22 and electromagnetic ON/OFF valves 23, 24 are provided halfway of the fuel gas supply tube 21.

The gas burning capacity control valve 22 controls an amount of fuel gas to be supplied to the burner 19 and the electro-magnetic valves 23 and 24 open and close the fuel gas supply tube 21.

The heating operation of the air conditioner thus arranged will be explained below.

With an operation switch, not shown, ON, the compressor 8 is started and the burner 19 of the combustion device 15 burns an air/fuel mixture.

A refrigerant which is delivered from the compressor 8 is fed, in a gaseous state, to the indoor heat exchanger 4 in the indoor unit 3 past the four-way valve 17 and corresponding refrigerant tube 2.

The refrigerant at the indoor-side heat exchanger 4 is condensed into a liquid form and liberates heat of condensation.

The indoor air is circulated by the indoor fan 5 of the indoor unit 1 and warmed through the indoor heat exchanger 4 and again blown into a room.

Thus warm air is blown into the room to be air-conditioned.

A refrigerant which is liquefied at the indoor heat exchanger 4 is supplied to the refrigerant heater 10 in the outdoor unit via the refrigerant tube 2.

The refrigerant tube 13 in the refrigerant heater 10 is heated by the action of a burning flame by the burner 19 at which time a refrigerant flowing through the refrigerant tube 13 for heating is heated into a gaseous phase. The refrigerant absorbs heat coming from the burner 19 as latent heat resulting from its gasification.

The gasified refrigerant is sucked into the compressor 8 past the accumulator 18.

The heating operation is continued through the circulation of the refrigerant.

Figure 2:
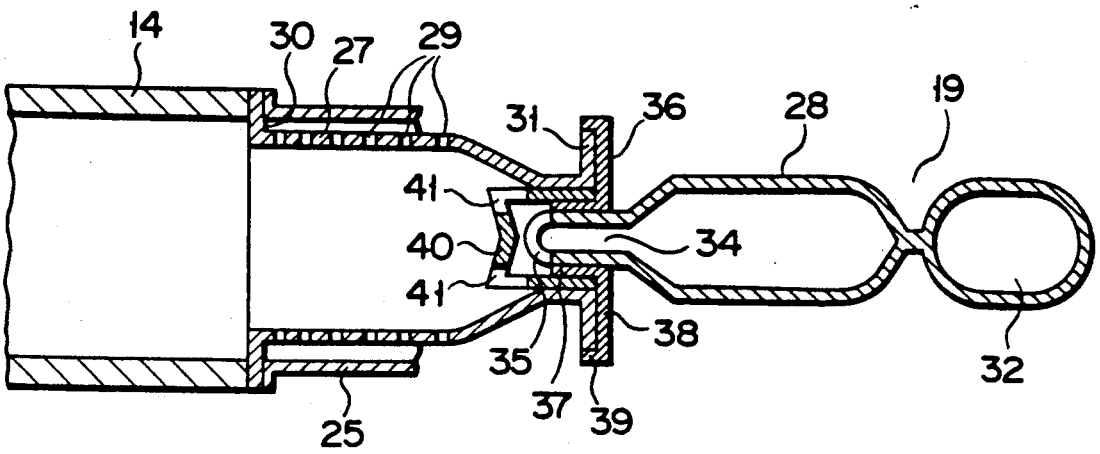
FIG. 2 is a view, in longitudinal cross-section, showing a burner for a combustion device in the present embodiment shown in FIG. 1.
Figure 3:
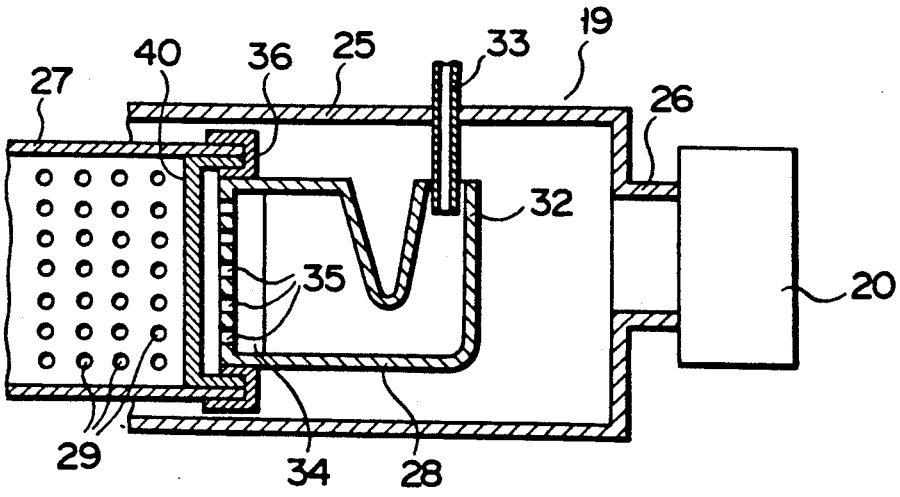
FIG. 3 is a view, in transverse section, showing the burner of the combustion device in the present embodiment shown in FIG. 1.
Figure 4:
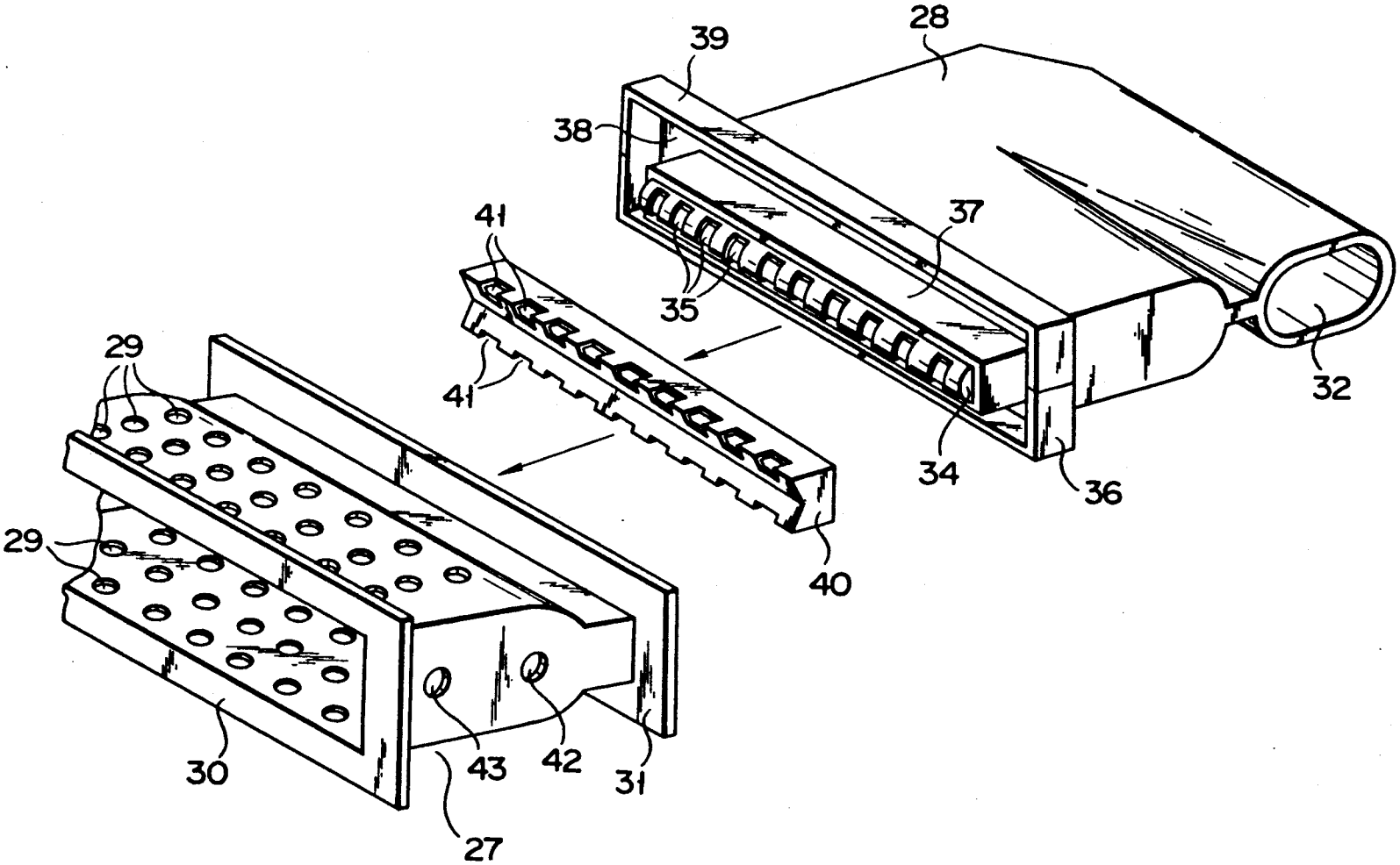
FIG. 4 is a perspective, expanded view showing the burner of the combustion device in the present embodiment showing in FIG. 1.

FIGS. 2 to 4 show the burner 19 in the combustion device 15.

A burner casing 25 is connected at one open end to the heater casing 14.

An inlet 26 for guiding combustion air blown from the fan 20 is provided at the other open end of the burner casing 25.

A cylinder 27 and mixer (air/fuel mixing chamber) 28 connected together are inserted into the burner casing 25.

The cylinder 27 is of a substantially rectangular configuration whose width is very long compared to a vertical extent or dimension of the cylinder 27. A greater number of secondary flame holes 29 are provided at the side surface corresponding to the vertical extent of the cylinder 27.

A flange 30 is provided along a marginal edge of one open end of the cylinder 27 in a manner to be integral with the cylinder 27.

The flange 30 is sandwiched between the heater casing 14 and the burner casing 25 and fixedly mounted there.

The cylinder 27 is provided such that its vertical dimension extent) is reduced toward its other open end and that the flange 31 is provided along the marginal edge of that open end in a manner to be integral with the cylinder 27.

The mixer 28 is assembled by press-working a sheet of metal and crimping it along the marginal edge.

An inlet section 32 is integrally provided at one side of the mixer 28 to receive a gaseous fuel to be mixed with primary air.

A fuel gas nozzle 33 is connected to the forward end portion of the gas supply tube 21 as set out above and extends through the burner casing 25 and is inserted into the inlet 32 of the mixer.

The external diameter of the fuel gas nozzle 33 is smaller than the internal diameter of the inlet section 32 of the mixer with a gap left therebetween.

The combustion air which is blown from the fan 20 is introduced into the inlet section 32 from the gap provided between the fuel gas nozzle 33 and the inlet section 32 of the mixer.

The mixer 28 is so formed as to have its vertical dimension reduced toward the other side of the mixer. A jetting outlet section 34 is integrally projected along the end edge of the mixer 28.

A plurality of jetting holes 35 are provided at the forward end of the jetting outlet section 34 such that they are located at a predetermined interval longitudinally of the jetting outlet section 34.

A fixing plate 36 is fixed to the base of the jetting outlet section 34 by, for example, attaching screws, spot welding or crimping.

The fixing plate 36 comprises a fixing section 37 fixed to the outer peripheral edge of the jetting outlet section 34, attaching section 38 integrally bent along one end of the fixing section 37, and a bent section 39 integrally bent along the marginal end of the attaching section 38.

The attaching section 38 is bent in a direction perpendicular to that in which the fixing section 37 is fixed to the jetting outlet section 34.

The bending direction of the bent section 39 is the same as that in which the fixing section 37 is fixed to the jetting outlet section 34.

The flange 31 of the cylinder 27 is fitted between the section 37 of the fixing plate 36 and the bent section 39 and fixed to the attaching section 38 of the fixing plate 36 by attaching screws, spot welding, crimping, etc.

A burner head 40 is inserted between the outer peripheral surface of the fixing section 37 of the fixing plate 36 and the inner surface of the cylinder's flange-side opening and fixed at that location.

One end section of the burner head 40 is an open end section fixed between the fixing section 37 and the flange section 31 and having a rectangular cross-section and the other end of the burner head 40 covers the jetting outlet section 34.

The end face, that is the other end, of the burner head is inwardly projected along the longitudinal direction of the burner head and that projecting end is located opposite to the middle of the jetting outlets 35 of the aforementioned jetting outlet section 34.

A plurality of diffusion holes 41 are provided at a predetermined interval at the upper and lower corners of the aforementioned projecting end of the burner head 40.

The diffusion holes 41 are located at a predetermined angle to the jetting holes 35.

The jetting outlet section 34, fixing section 37 of the fixing plate 36 and burner head 40 are projected into the cylinder 27 from the flange side's opening of the cylinder 27.

Of these sections 34, 37 and 40, the burner head 40 is projected to a greatest extent because it covers the jetting outlet section 34.

The diffusion holes 41 are located at a given angle to the wall surface of the cylinder 27.

In the side wall of the cylinder 27 are provided an attaching hole 42 for attaching a spark plug electrode and attaching hole 43 for attaching a flame rod electrode.

The function of the burner 19 of the combustion device 15 will be explained below.

Combustion air blown from the fan 20 is conducted to the burner casing 25 via the inlet 26.

A fuel gas introduced into the fuel gas supply tube 21 is delivered into the inlet section 32 from the fuel gas nozzle 33.

A combustion air is introduced as primary air into the mixer 28 via the gap between the outer periphery of the fuel gas nozzle 33 and the inlet section 32 to allow the fuel gas to be mixed with the primary air.

The fuel gas and combustion air collide against a facing wall surface upon being introduced into the mixer 28 and are directed in a direction perpendicular to that in which they are introduced.

The introduced fuel gas and combustion air are uniformly mixed in the mixer 28.

The air/fuel mixture is conducted, in a rectified stream, to the jetting holes 34 and jetted via the jetting holes into the burner head 40.

The air/fuel mixture collides against the projecting end of the burner head 40 and are guided, in a dispersed stream, in the upper and lower directions along a slant surface of the projecting end of the burner head 40.

The diffusion holes 41 are opened in a direction in which the mixture is dispersed in the burner head 40, directing it from the diffusion holes 41 into the cylinder 27.

Since the diffusion holes 41 face the wall surface of the cylinder 27 at a given angle, the mixture is effectively dispersed in the cylinder 27.

A spark plug, not shown, which is provided at the cylinder 27 is ignited, firing the mixture.

The combustion air in the cylinder 27 is admitted via secondary flame holes 29 into the burner casing 25 where it is mixed, as secondary air, with the mixture.

A better burning occurs in the cylinder 27.

The flame in the cylinder 27 enters the heater casing 14.

The refrigerant tube 13 provided within the heater casing 14 is heated by a burning gas to allow the refrigerant which passes through the refrigerant tube 13 to be heated.

After a heat exchange is made between the gas and the refrigerant, a waste gas is exhausted to an outside via the exhaust top 16.

The assembly of the burner 19 is achieved in the following way.

The fixing section 37 of the fixing plate 36 is fixed to the jetting outlet section 34 of the mixer 28 of a predetermined configuration by attaching screws, spot welding, crimping, etc.

This is the rightest component part as shown in FIG. 4.

The flange 31 of the cylinder 27 is inserted between the fixing section 37 of the fixing plate 36 and the bent section 39 and the flange 31 is closely attached to the attaching section 38 of the fixing section 36.

The flange 31 of the cylinder 27 is attached to the attaching section 38 of the fixing plate 36 by a spot welding, crimping, etc.

At that time, the burner head 40 is initially fixed to the flange's open end of the cylinder 27.

The other open end of the cylinder 27 of an assembly of the mixer 28, fixing plate 36 and cylinder 27 is connected to the open end of the heater casing 14.

The fixing plate 36 and cylinder 27 are covered by inserting the burner casing 25 over the cylinder 27 from the mixer side.

The open end of the burner casing 25 is fixedly mounted on the heater casing 14 and necessary component parts, such as a fuel gas nozzle, spark plug, etc., are attached to the cylinder 27 through the burner casing 25. It is thus possible to complete that burner 19.

Upon the assembly of the burner 19, it is not necessary to employ an arc welding means which would otherwise be required in the conventional burner. It is only necessary to make a simple assemble operation.

Thus the burner of the present invention can be assembled efficiently in a simple operation without involving any unwanted displacement and any thermal deformation resulting from the use of, for example, the arc welding means.

Further, the burner of the present invention can control a leakage of primary air during the burning of a fuel/air mixture by the burner and ensures a normal, steady burning state at all times.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A burner for a combustion device, comprising:

a fuel gas nozzle for supplying a fuel gas;

a mixer into which the fuel gas nozzle is inserted on one side and including an inlet section for introducing combustion air via a gap defined therearound to mix a fuel gas with the combustion air in the mixer;

a jetting outlet section integrally projected on the other side of the mixer and having jetting holes for jetting the fuel gas and combustion air which are mixed in the mixer;

a cylinder fixed to the jetting outlet section, having a substantially rectangular open end and adapted to allow the mixture to be burned; and a burner head fixed to the cylinder and including diffusion holes for diffusing the mixture which is jetted from the jetting holes.

2. A burner according to claim 1, wherein said inlet section of said mixer allows an incoming fuel gas to, together with said combustion air, collide against an opposite wall surface of the mixer so that both are directed toward the jetting holes in a direction perpendicular to a direction in which they are introduced.

3. A burner according to claim 1, wherein said jetting outlet section of said mixer is projected with its vertical dimension reduced to allow said mixture to be jetted via said jetting holes after being rectified.

4. A burner according to claim 1, wherein said cylinder circumferentially takes in secondary air and having secondary flame holes for forming a flame pattern.

5. A burner according to claim 1, wherein said burner head has a rectangular opening initially. connected to an associated opening of said cylinder with said jetting, outlet section extending therein.

6. A burner according to claim 1, wherein said burner has an outer face opposite to the jetting holes of said jetting outlet section projected inwardly along a longitudinal direction.

7. A burner according to claim 1, wherein said diffusion holes are provided at a predetermined interval at those upper and lower corners of said burner head to allow said mixture to be diffused at a predetermined angle toward the wall of said cylinder.

8. A burner for a combustion device, comprising:

a fuel gas nozzle for supplying a fuel gas;

a mixer into which the fuel gas nozzle is inserted on one side and including an inlet section for introducing combustion air via a gap defined therearound to mix it with a fuel gas;

a jetting outlet section integrally projected on the other side of the mixer and having jetting holes for jetting the fuel gas and combustion air which are mixed in the mixer;

a fixing plate fitted around the jetting outlet section;

a cylinder fixed to the fixing plate and having a substantially rectangular opening and adapted to allow the mixture to be formed; and a burner fixed fixed to the cylinder and including diffusion holes for diffusing the mixture which is jetted from the jetting holes.

9. A burner according to claim 8, wherein said fixing plate comprises a fixing section fixed to said jetting outlet section, an attaching section integrally bent along the end of the jetting outlet section in a direction perpendicular to that in which the fixing section is fixed to the jetting outlet section, and a section integrally bent in the same direction as that in which the fixing section is fixed to the jetting outlet section.

10. A burner according to claim 8, wherein said cylinder has a flange formed at an open end and fixed to said fixing plate.

* * * * *